US006328497B1

(12) United States Patent
To

(10) Patent No.: US 6,328,497 B1
(45) Date of Patent: Dec. 11, 2001

(54) RING MECHANISM FOR A BINDER HAVING A PLASTIC TOP SECTION

(75) Inventor: Chun Yuen To, New Territories (HK)

(73) Assignee: World Wide Stationery Manufacturing Co., Ltd., New Territories (HK)

( * ) Notice: Subject to any disclaimer, the term of this patent is extended or adjusted under 35 U.S.C. 154(b) by 0 days.

(21) Appl. No.: 09/755,402

(22) Filed: Jan. 3, 2001

(51) Int. Cl.[7] ..... B42F 13/00

(52) U.S. Cl. ..... 402/26; 402/31; 402/32; 402/36

(58) Field of Search ..... 402/26, 31, 32, 402/33, 36–42, 46, 48, 80 R

(56) References Cited

U.S. PATENT DOCUMENTS 1,927,802 * 9/1933 McMillan ..... 402/32

4,128,356 * 12/1978 Carlisle ..... 402/26 X

* cited by examiner

*Primary Examiner*—Willmon Fridie, Jr.
(74) *Attorney, Agent, or Firm*—Skjerven, Morrill, MacPherson LLP; David E. Steuber

(57) ABSTRACT

A ring for mounting on a carrier mechanism of a binder is disclosed. The ring includes a first ring element and a second ring element. The first ring element includes a first ring element bottom section, which is connected to the carrier mechanism, and a first ring element top section. The first ring element top section includes a first end and a second end. Similarly, the second ring element includes a second ring element bottom section, which is connected to the carrier mechanism, and a second ring element top section. The second ring element top section includes a first end and a second end. The first end of the second ring element top section is joined to the second ring element bottom section, while the second end is adapted for coupling with the second end of the first ring element top section.

8 Claims, 13 Drawing Sheets

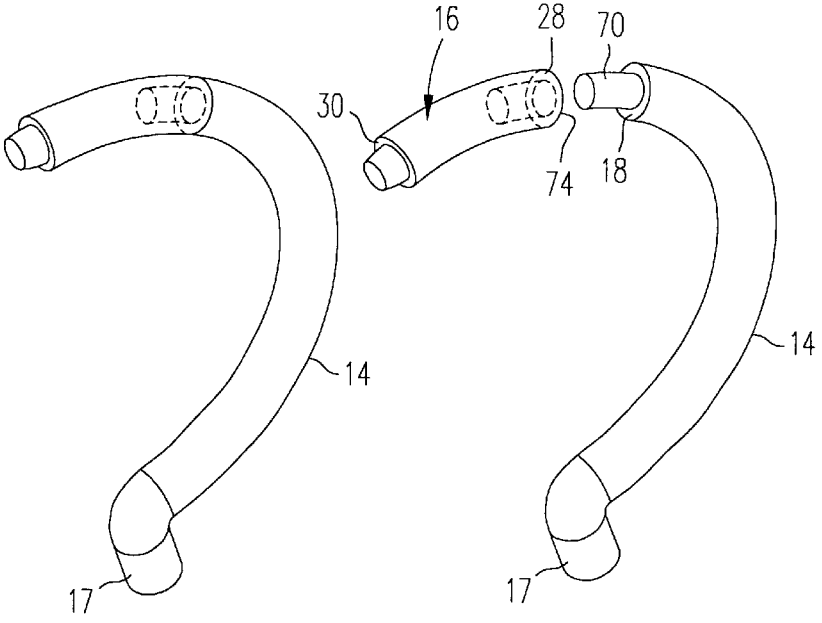
FIG. 3D
FIG. 3C
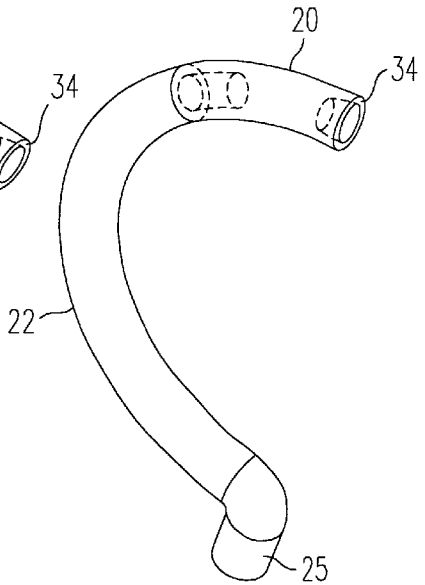
FIG. 3B
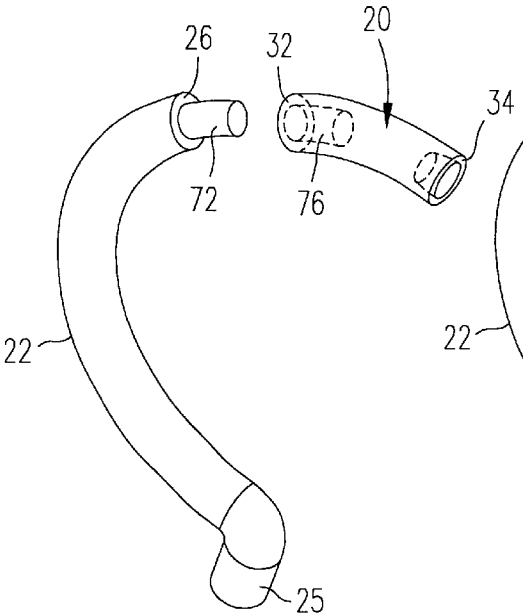
FIG. 3A

RING MECHANISM FOR A BINDER HAVING A PLASTIC TOP SECTION

FIELD OF THE INVENTION

The present invention relates to a ring mechanism adapted for mounting in loose-leaf binders and the like.

BACKGROUND

A variety of ring mechanisms exist for looseleaf binders and the like. Common to these mechanisms is the provision of elements forming a ring, the elements extending outwardly from carrier rails in some designs. The carrier rails are located within a cover rail, and the ring elements extend through rings in the cover rail. In most known mechanisms, the ring elements extend outwardly from the cover rails such that, in a closed position, the ring elements form a generally circular closure.

With many binders, the ring mechanism is intended to be operated by gripping the ring elements of the rings. The ring elements are then manually moved between the opened and closed overcenter positions. In some designs, the entire ring mechanism (typically including three rings and sometimes more than three rings) is opened only if a single designated ring—the "exclusive opening" ring—is opened. However, presently, it is difficult for the user to quickly determine which ring on a ring mechanism is the exclusive opening ring. Similarly, rings having other special functions (e.g., rings capable of being folded down within the binder for more compact storage) cannot easily be distinguished from other rings on the same ring mechanism.

There is a need, therefore, for a simple, inexpensive modification to a ring design which can be used to distinguish an exclusive opening ring or a ring having some special function from other rings mounted on a carrier mechanism.

SUMMARY

The present invention addresses these needs, by providing a ring mechanism with a unique design, so that the ring mechanism may be easily differentiated from other rings mounted on a carrier mechanism. The ring includes bottom sections and top sections, the top sections being made from a colored plastic material.

A ring for mounting on a carrier mechanism of a binder is described. The ring includes a first ring element and a second ring element. The first ring element includes a first ring element bottom section, which is connected to the carrier mechanism, and a first ring element top section. The first ring element top section includes a first end and a second end. Similarly, the second ring element includes a second ring element bottom section, which is connected to the carrier mechanism, and a second ring element top section. The second ring element top section includes a first end and a second end. The first end of the second ring element top section is joined to the second ring element bottom section, while the second end is adapted for coupling with the second end of the first ring element top section.

When the ring of the present invention is in a closed position, the first ring element top section and the second ring element top section, being made of a colored plastic, are easily detected in juxtaposition with other rings mounted on the carrier mechanism.

BRIEF DESCRIPTION OF THE DRAWINGS

The present invention may be better understood and its numerous features and advantages made apparent to those skilled in the art by referencing the accompanying drawings.

FIGS. 3A–3D are perspective views of the ring mechanism of FIG. 1, illustrating a first ring element and a second ring element detached and attached to respective first ring element and second ring element top sections.

DETAILED DESCRIPTION

Figure 1:
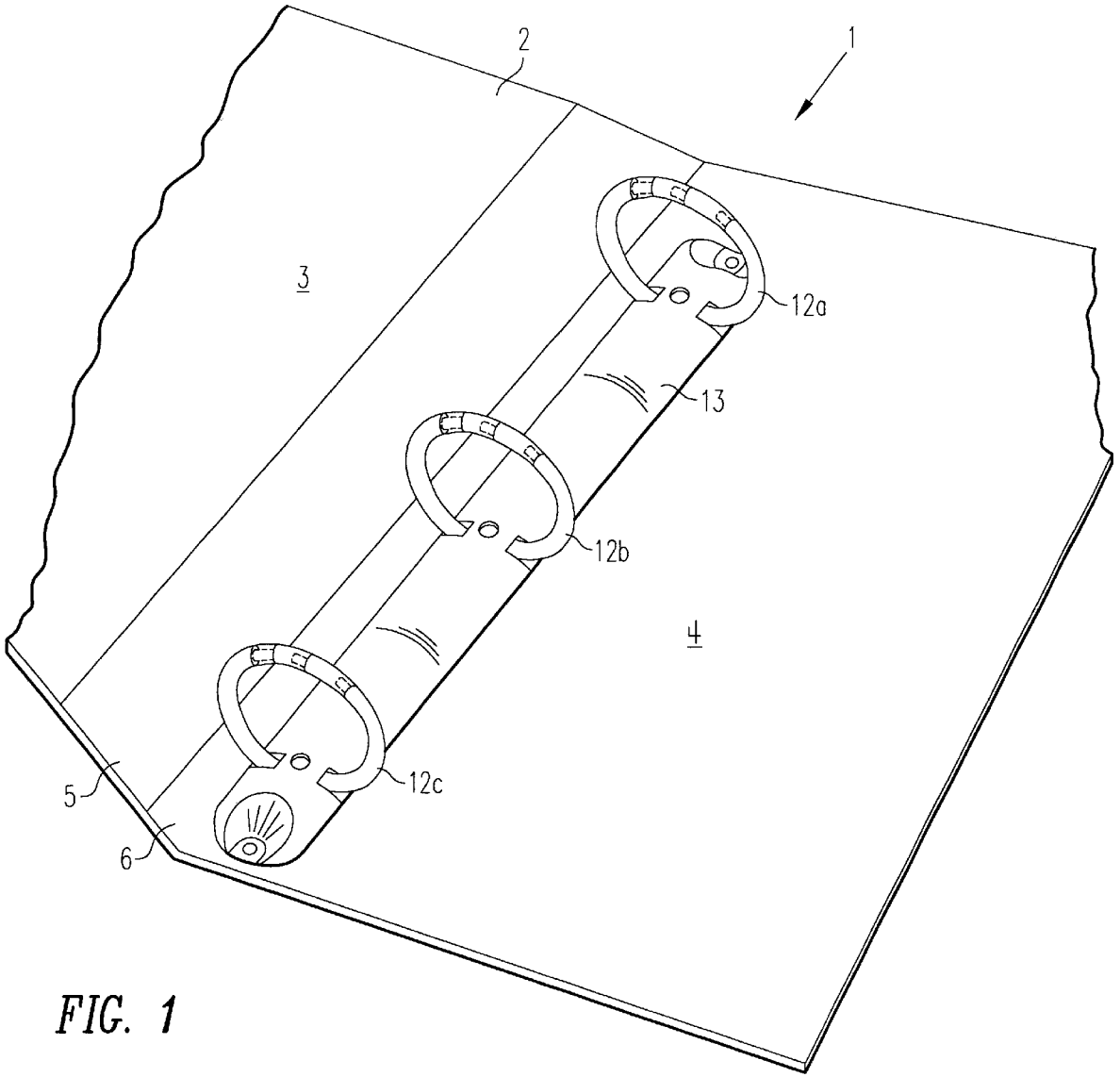
FIG. 1 is a perspective view of a ring mechanism according to the present invention as mounted on a binder, showing the ring mechanism in a closed position.

Referring now to the drawings, wherein similar parts are identified by like reference numerals, FIG. 1 illustrates three ring mechanisms 12*a,* 12*b,* and 12*c* mounted on a binder 2. Binder 2 includes front and back cover members 3 and 4 respectively, and a spine 5 connected by fabric hinges 6. Ring mechanisms 12*a,* 12*b,* and 12*c* are mounted on the rear cover member 4 by a carrier mechanism 13. The manner in which the ring mechanism 1 is mounted to the rear cover member 4 is not relevant to the invention. An exemplary method for mounting any number of ring mechanisms to the rear cover member 4 is explained in greater detail hereinbelow, after discussion of the ring mechanism. Also, although 3 ring mechanisms are shown mounted to binder 2 in FIG. 1, fewer or more ring mechanisms may be mounted on the binder in accordance with the invention.

Figure 2:
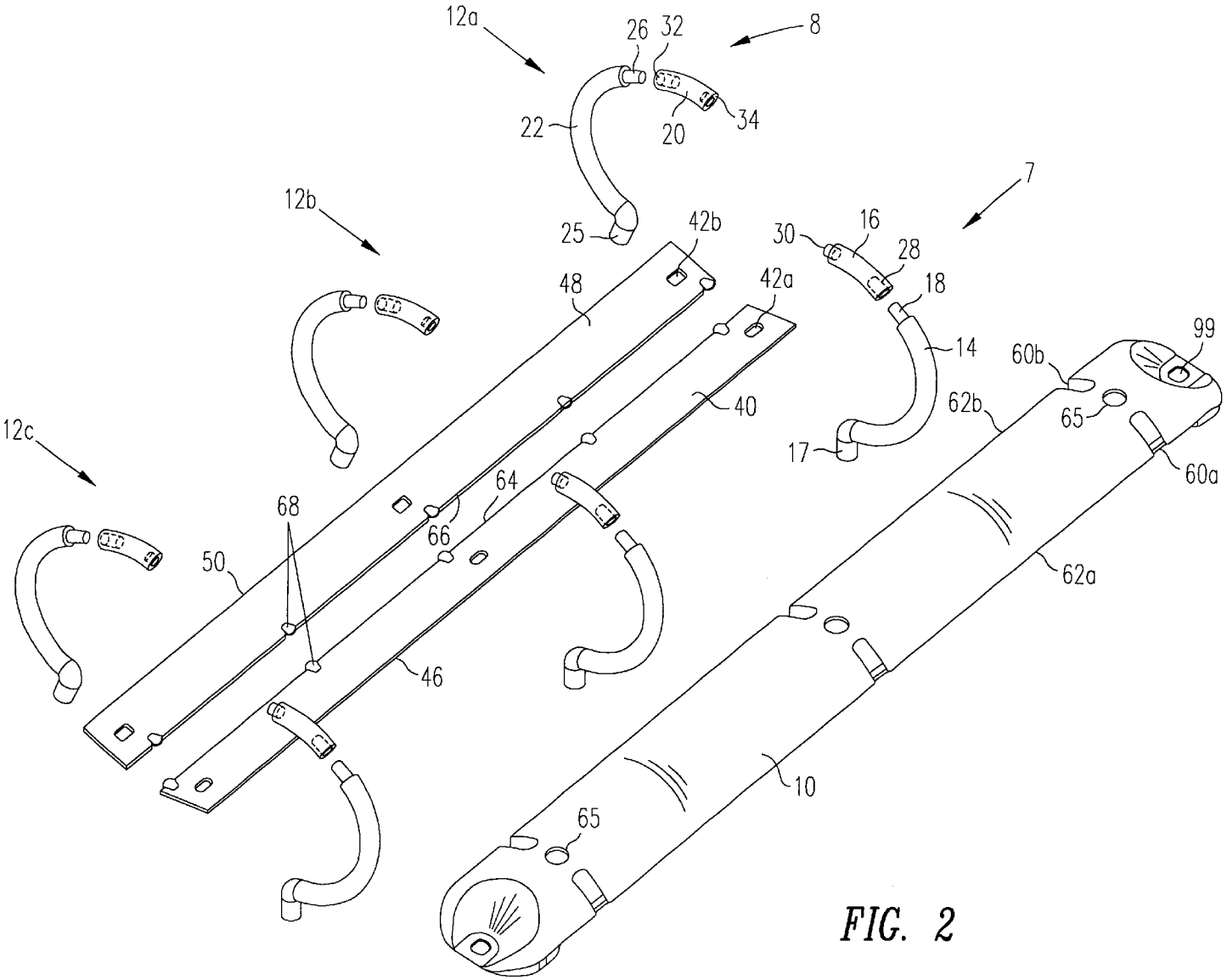
FIG. 2 is an exploded perspective view of the ring mechanism of FIG. 1, illustrating the connection of the ring mechanism to carrier rails and a cover rail.

Referring now to FIG. 2, it can be seen each ring mechanism 12*a,* 12*b,* 12*c* includes a first ring element 7 and a second ring element 8. (For clarity of presentation, only the elements of ring mechanism 12*a* are labeled, as they are structurally identical to elements of ring mechanism 12*b,* 12*c.*) First ring element 7 includes a first ring element bottom section 14 and a first ring element top section 16. A post 17 connects first ring element bottom section 14 to a carrier rail 40, which is part of carrier mechanism 13. Similarly, second ring element 8 includes a second ring element bottom section 22 and a second ring element top section 20. A post 25 connects second ring element bottom section 22 to a carrier rail 48, which is part of ring mechanism 13. Connection of the first and second ring element bottom sections to their respective carrier rails is discussed in greater detail below.

First ring element top section 16 includes a first end 28 and a second end 30. First end 28 is adapted to be joined to first ring element bottom section 14. Similarly, second ring element top section 20 includes a first end 32 and a second end 34. First end 32 is adapted to be joined to second ring element bottom section 22. The second end 34 of the second ring element top section 20 is adapted for coupling with second end 30 of the first ring element top section 16. When the ring is in a closed position, the first ring element bottom section 14, the first ring element top section 16, the second ring element top section 20, and the second ring element bottom section 22 define a loop, as can be seen by reference to FIG. 1.

According to the invention, first ring element top section 16 and second ring element top section 20 are made from a plastic material, while first ring element bottom section 14 and second ring element bottom section 22 are made from a metal. The plastic material selected for first ring element top section 16 and second ring element top section 20 should be durable and non-brittle, so that the top sections do not crack after repeatedly opening and closing the ring mechanism. Exemplary plastic materials include acrylonitrile-butadiene-styrene (ABS) and nylon. The metal used for first ring element bottom section 14 and second ring element bottom section 22 may be steel, aluminum, or galvanized aluminum, for example.

The invention is especially useful for binder designs where all of the ring mechanisms within the binder may be opened by opening a single ring mechanism (herein designated as the exclusive-opening ring mechanism). Preferably, the exclusive-opening ring mechanism has plastic top sections which are brightly colored. In one embodiment, all of the ring mechanisms within the binder have the inventive design just described (as is illustrated in FIG. 2), but the exclusive-opening ring mechanism contains at least one top section that has a color different from all other ring mechanism top sections within the binder. In another embodiment, only one of the two or more ring mechanisms in the binder have the inventive design just described, while the remaining ring mechanisms are conventional in their design. In all of these embodiments, the user may determine which ring mechanism may be manipulated to open all of the ring binders by a quick visual inspection of the top sections of each ring mechanism.

As may be more easily appreciated by reference to FIGS. 3A–3D, in one embodiment, the first ring element bottom section 14 includes a male fitting 70. Second ring element bottom section 22 likewise includes a male fitting 72. First end 28 of the first ring element top section 16 includes a sleeve 74. First end 32 of the second ring element top section 20 likewise includes a sleeve 76. Male fitting 70 of first element bottom section 14 may thus be inserted in sleeve 74 of first ring element top section 16 (see FIG. 3C); similarly, male fitting 72 of second ring element bottom section 22 may thus be inserted in sleeve 76 of second ring element top section 20 (see FIG. 3B). Second end 34 of second ring element top section 20 is adapted for coupling with the second end 30 of the first ring element top section 16.

Male fitting 70 of first ring element bottom section 14 and male fitting 72 of second ring element bottom section 22 may be joined to sleeve 74 of first ring element top section 16 and sleeve 76 of second ring element top section 20, respectively, by several methods. Preferably, these elements are joined together by a snap-fit or press-fit. The outer diameters of the male fittings 70, 72 should be just slightly larger than the inner diameters of sleeves 74, 76 so that these element are tightly fitted with each other to withstand pressure associated with repeated opening and closing of the rings. Of course, other methods may be used to join these elements, including, for example, various adhesives and epoxies.

Figures 4A, 4B, 4C, 4D:
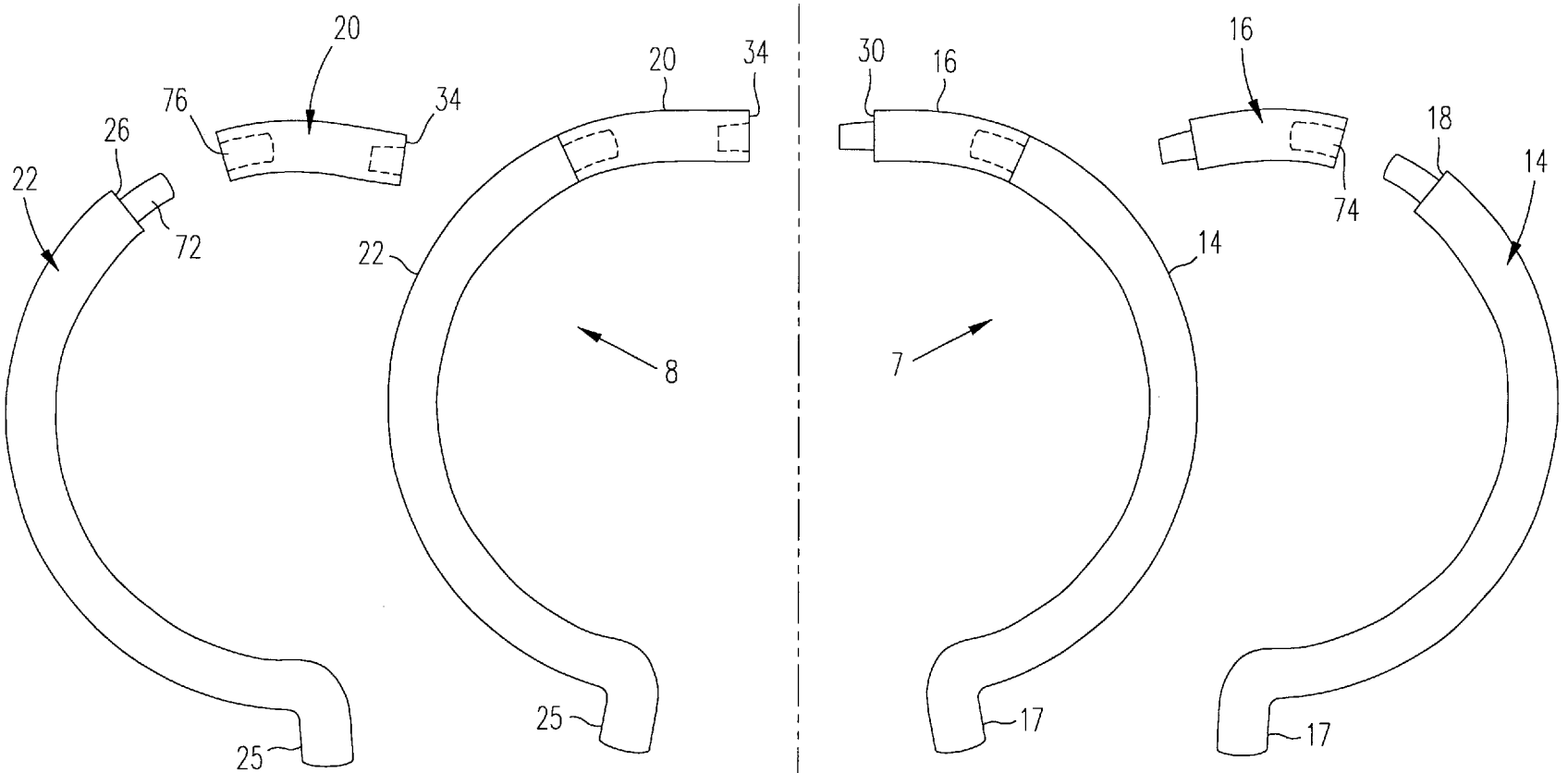
FIGS. 4A–4D are cross-sectional views of the ring mechanism of FIG. 1, illustrating a first ring element top section and a second ring element top section detached and attached to respective first ring element and second ring element bottom sections.

As shown in FIG. 4B and FIG. 4C, when assembled as just described, first ring element 7 and second ring element 8 are substantially symmetrical about a vertical plane. In this embodiment, the combined length of first ring element top section 16 and second ring element top section 20 is at least 20% of the total circumference of the ring mechanism when closed.

Figure 5:
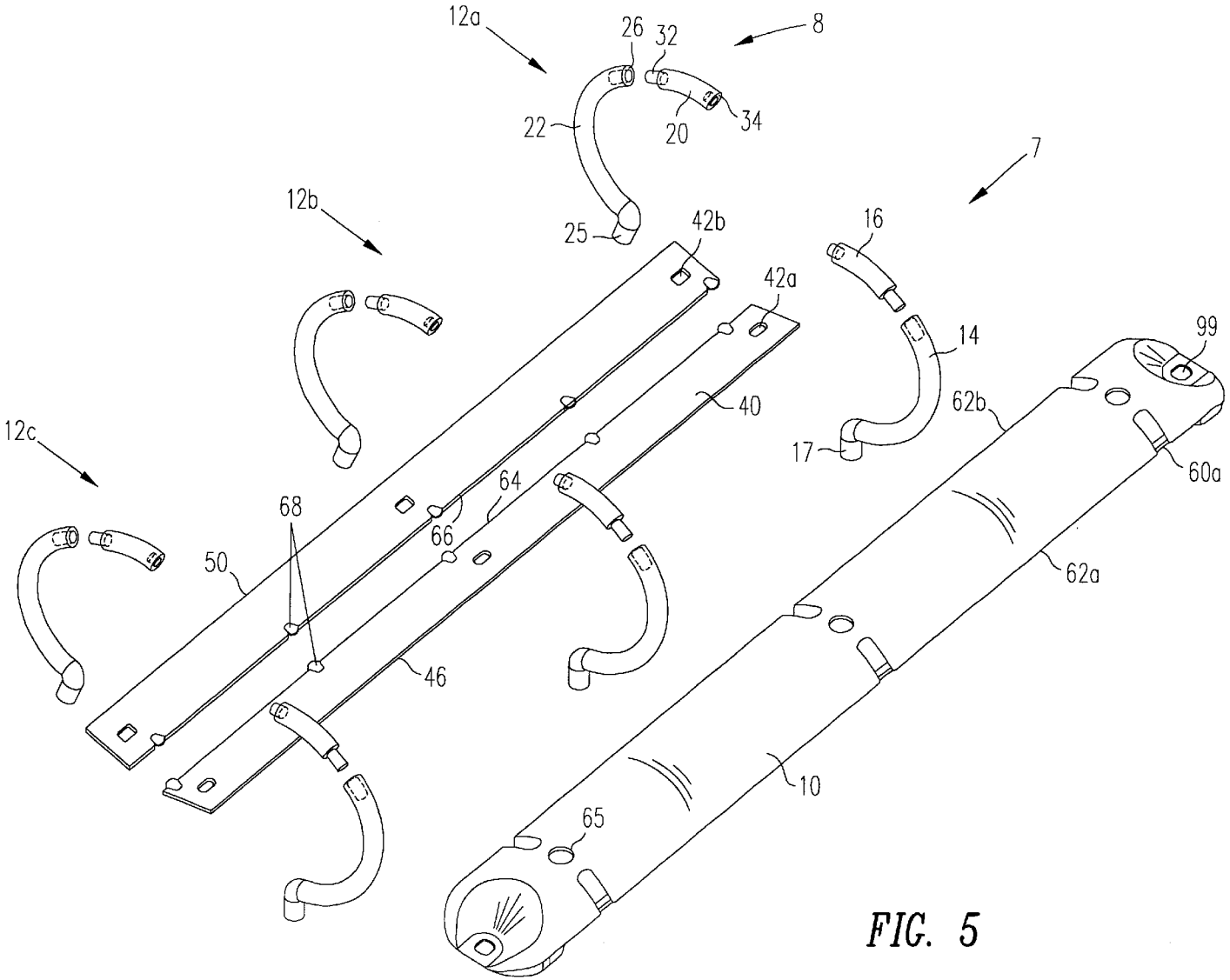
FIG. 5 is an exploded perspective view of a second embodiment of the ring mechanism, illustrating the connection of the ring mechanism to carrier rails and a cover rail.
Figures 6A, 6B, 6C, 6D:
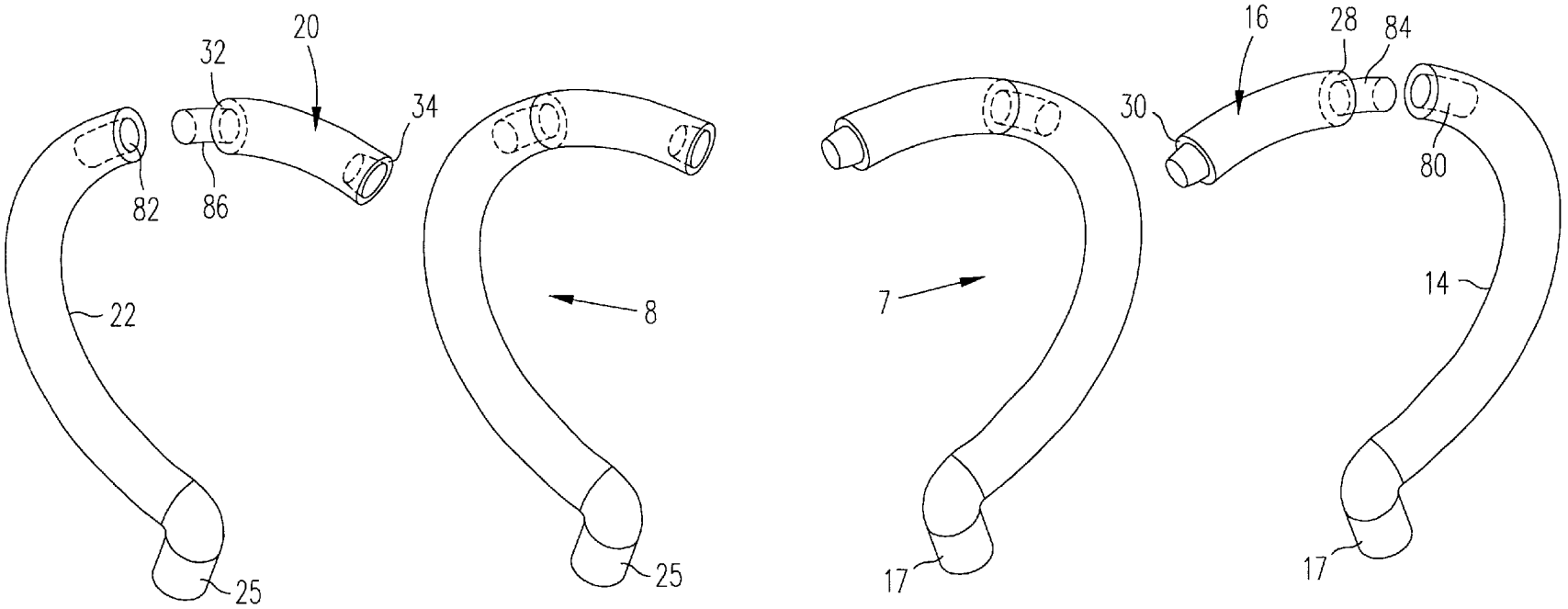
FIGS. 6A–6D are perspective views of the ring mechanism of FIG. 5, illustrating a first ring element and a second ring element detached and attached to respective first ring element and second ring element top sections.
Figures 7A, 7B, 7C, 7D:
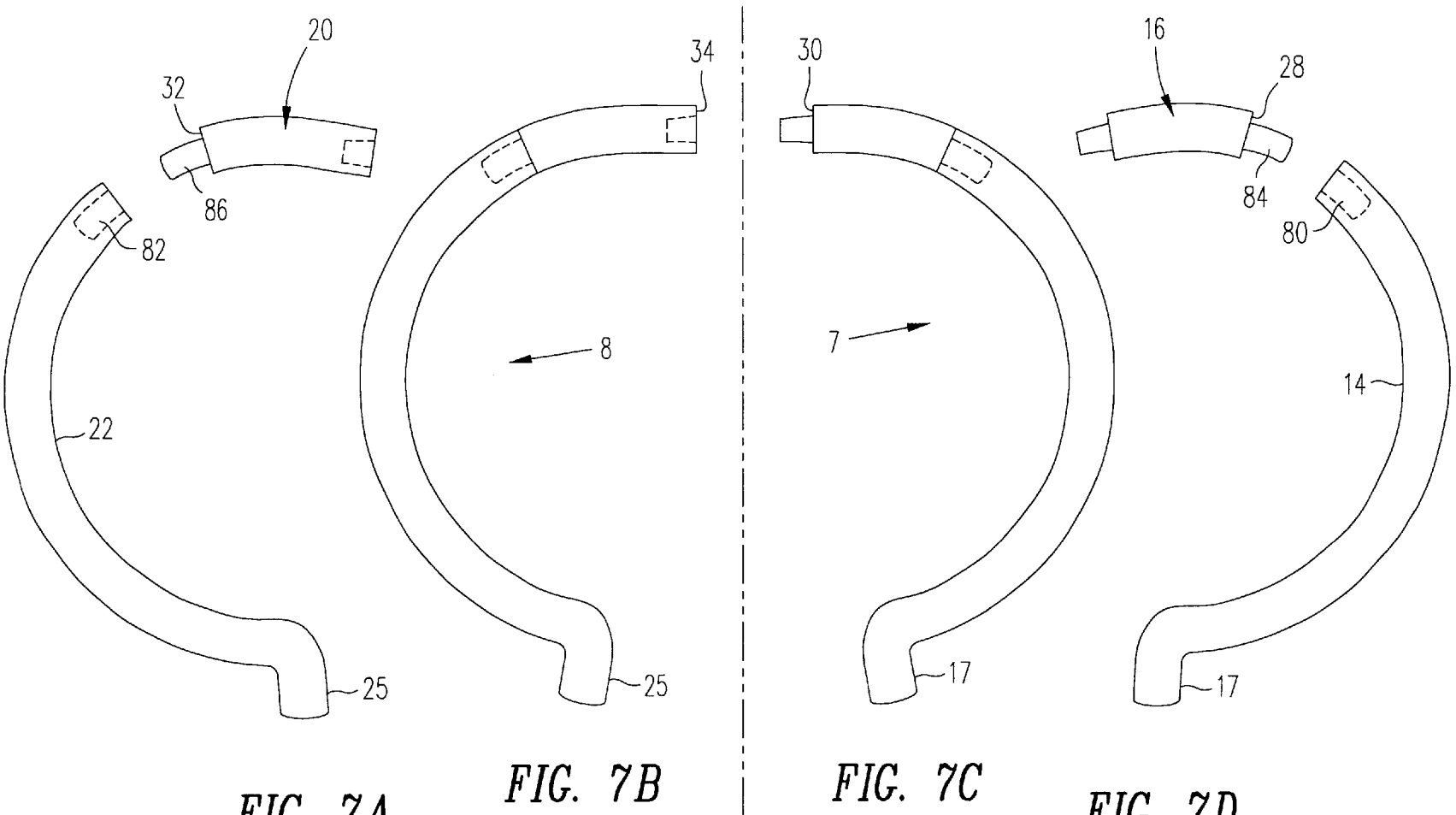
FIGS. 7A–7D are cross-sectional views of the ring mechanism of FIG. 5, illustrating a first ring element top section and a second ring element top section detached and attached to respective first ring element and second ring element bottom sections.

FIG. 5 is an exploded perspective view of a second embodiment of the ring mechanism, illustrating the connection of the ring mechanism to carrier rails and a cover rail. As may be more easily appreciated by reference to FIGS. 6A–6D, in the embodiment illustrated in FIG. 5, first element bottom section 14 includes a sleeve 80. Second element bottom section 22 likewise includes a sleeve 82. First end 28 of first ring element top section 16 includes a male fitting 84. First end 32 of the second ring element top section 20 likewise includes a male fitting 86. Male fitting 84 of first element top section 16 may thus be inserted in sleeve 80 of first ring element bottom section 16 (see FIG. 6C); similarly, male fitting 86 of second ring element top section 20 may thus be inserted in sleeve 82 of second ring element bottom section 22 (see FIG. 6B). As in the embodiment illustrated in FIG. 2, the second end 34 of second ring element top section 20 is adapted for coupling with the second end 30 of the first ring element top section 16. As shown in FIG. 7B and FIG. 7C, when so assembled, first ring element 7 and second ring element 8 are substantially symmetrical about a vertical plane.

Figure 8:
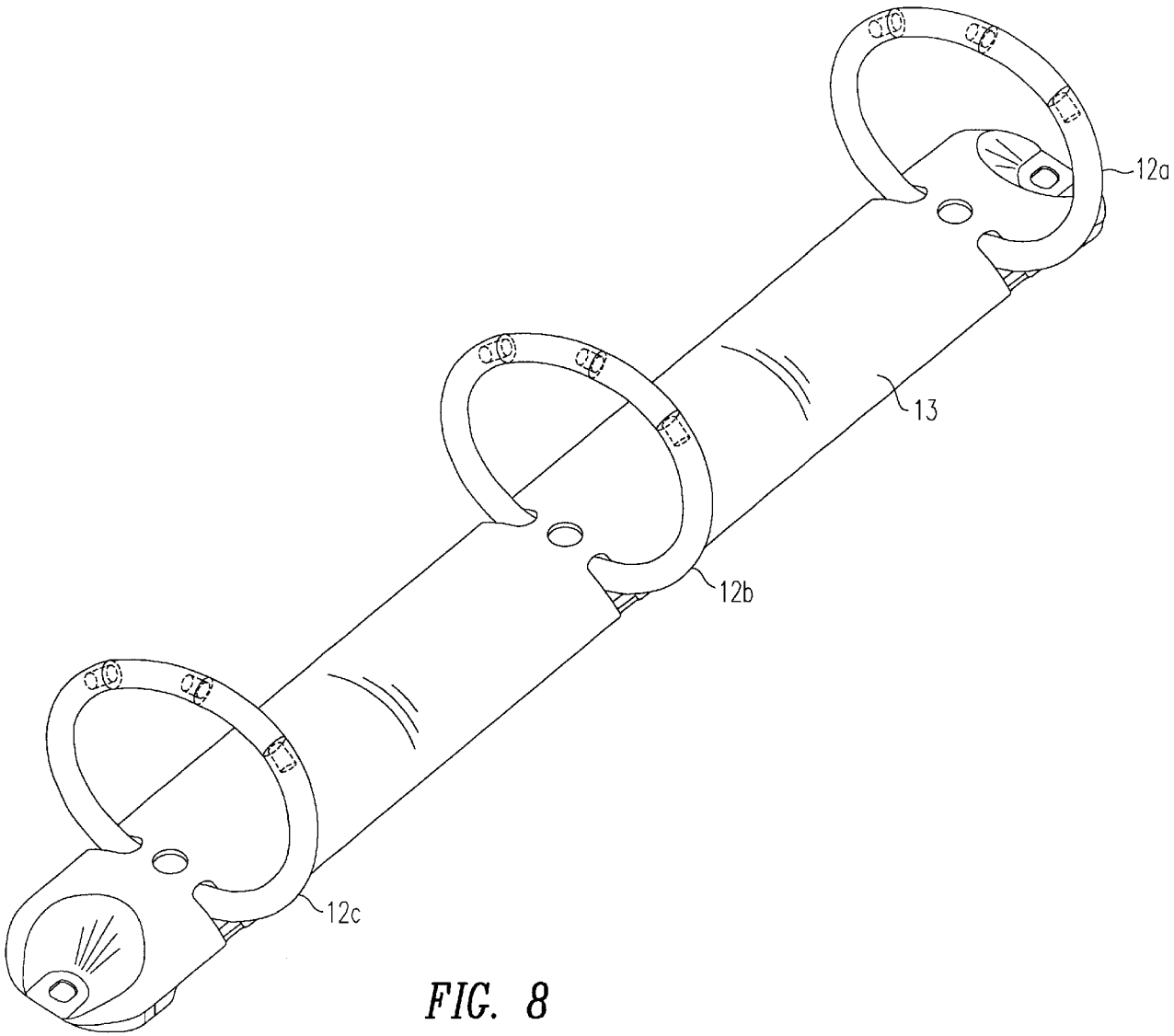
FIG. 8 is a perspective view of a second embodiment of the ring mechanism of FIG. 5, where the mechanism is in a closed position and mounted on a carrier mechanism.

FIG. 8 illustrates the ring mechanism of FIG. 5, where the ring mechanism is in a closed position and mounted on a carrier mechanism 13. Details regarding one method for mounting the ring mechanism of the present invention on a carrier mechanism are now briefly presented. More information regarding this method for mounting a ring mechanism on a carrier mechanism may be found in the commonly owned U.S. Pat. No. 4,552,478, the disclosure of which is incorporated by reference herein.

Figure 9A:
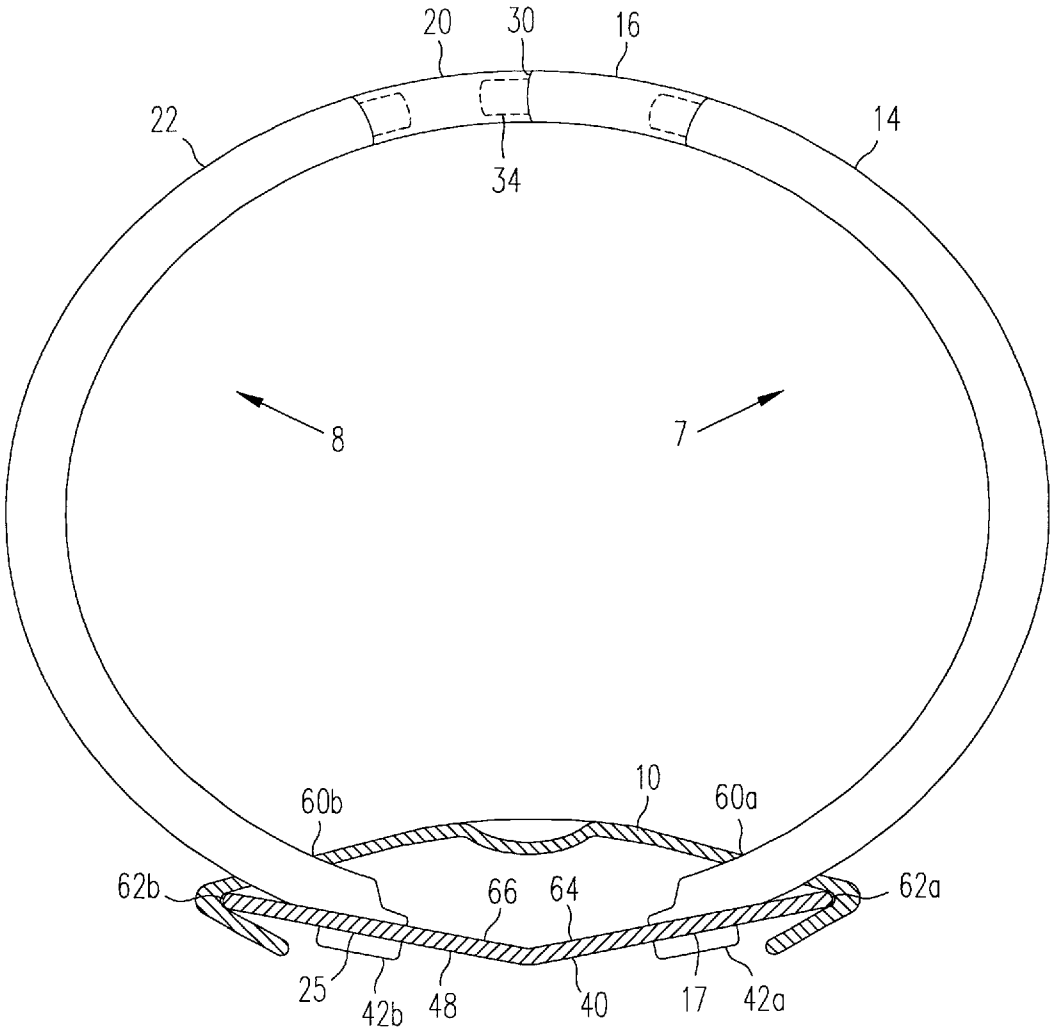
FIG. 9A is an end view of a ring mechanism according to the present invention, showing the ring mechanism in a closed position, in conjunction with an associated cover rail and carrier rails.

Referring now to FIG. 9A, each ring mechanism includes first ring element 7 and second ring element 8. Post 17 of first ring element 7 is secured in position to first carrier rail 40 by, for example, welding it to carrier rail 40 after passing post 17 through aperture 60*a* of cover rail 10 and aperture 42*a* of carrier rail 40. Similarly, post 25 of second ring element 8 is secured in position to second carrier rail 48 by, for example, welding it to carrier rail 48 after passing post 25 through aperture 60*b* of cover rail 10 and aperture 42*b* of second carrier rail 48.

Referring again to FIG. 2, cover rail 10 is provided with inwardly turned edges 62*a,* 62*b* for engaging first carrier rail 40 and second carrier rail 48, respectively. Outer edges 46 and 50 of first carrier rail 40 and second carrier rail 48 abut the inwardly turned edges 62*a,* 62*b,* respectively of cover rail 10. Inner edges 64 and 66 of the first and second carrier rails 40 and 48 lie against or abut one another. First and second carrier rails 40 and 48 are additionally provided with tabs 68 that overlap one another, so as to prevent relative displacement between inner edges 64 and 66 and to maintain inner edges 64, 66 in contact with one another. Cover rail 10 is formed from a resilient material such as steel.

Referring again to FIG. 9A, the carrier rails 40, 48 are shown in a closed overcenter position. In this position, the edges 64, 66 of carrier rails 40, 48 are adjacent the bottom of the cover rail 10. Second end 34 of second ring element top section 20 couples with second end 30 of first ring element top section 16 to form a complete ring.

Figure 9B:
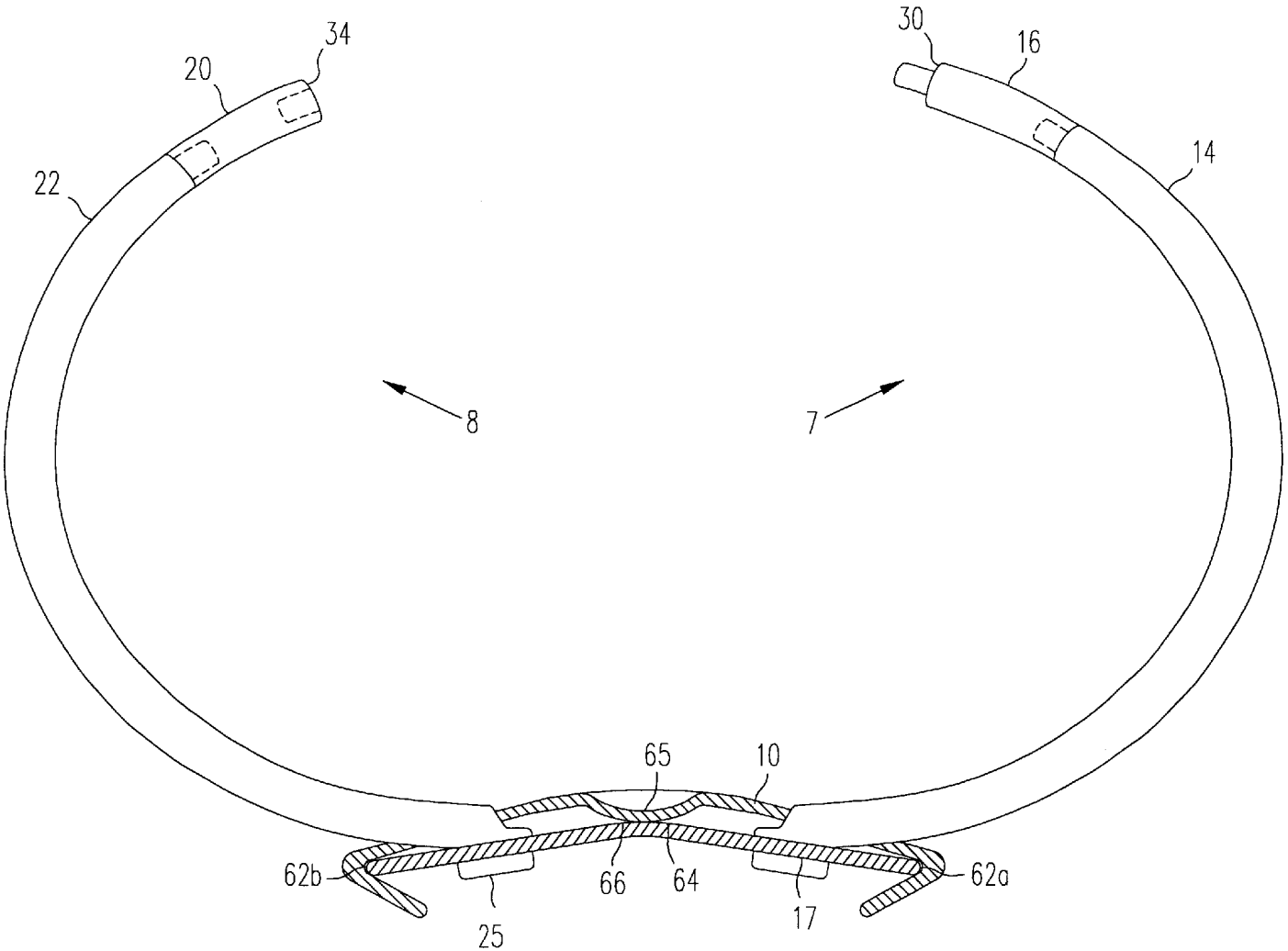
FIG. 9B is an end view of the ring mechanism according to the present invention, showing the ring mechanism in an open position, in conjunction with an associated cover rail and carrier rails.

In FIG. 9B, the carrier rails 40, 48 have been moved to an open overcenter position, in which the edges 64, 66 of the carrier rails 40, 48 are at the top of the cover rail 10 and the second end 34 of second ring element top section 20 is disengaged from second end 30 of first ring element top section 16, thereby separating first ring element 7 from second ring element 8. As is shown in FIG. 9B, the cover rail 10 can be further provided with a dimple or projection 65, serving to limit the position of the carrier rails 40, 48 in the open position, and thus effectively limit the opening of the ring elements 7, 8.

Figure 9C:
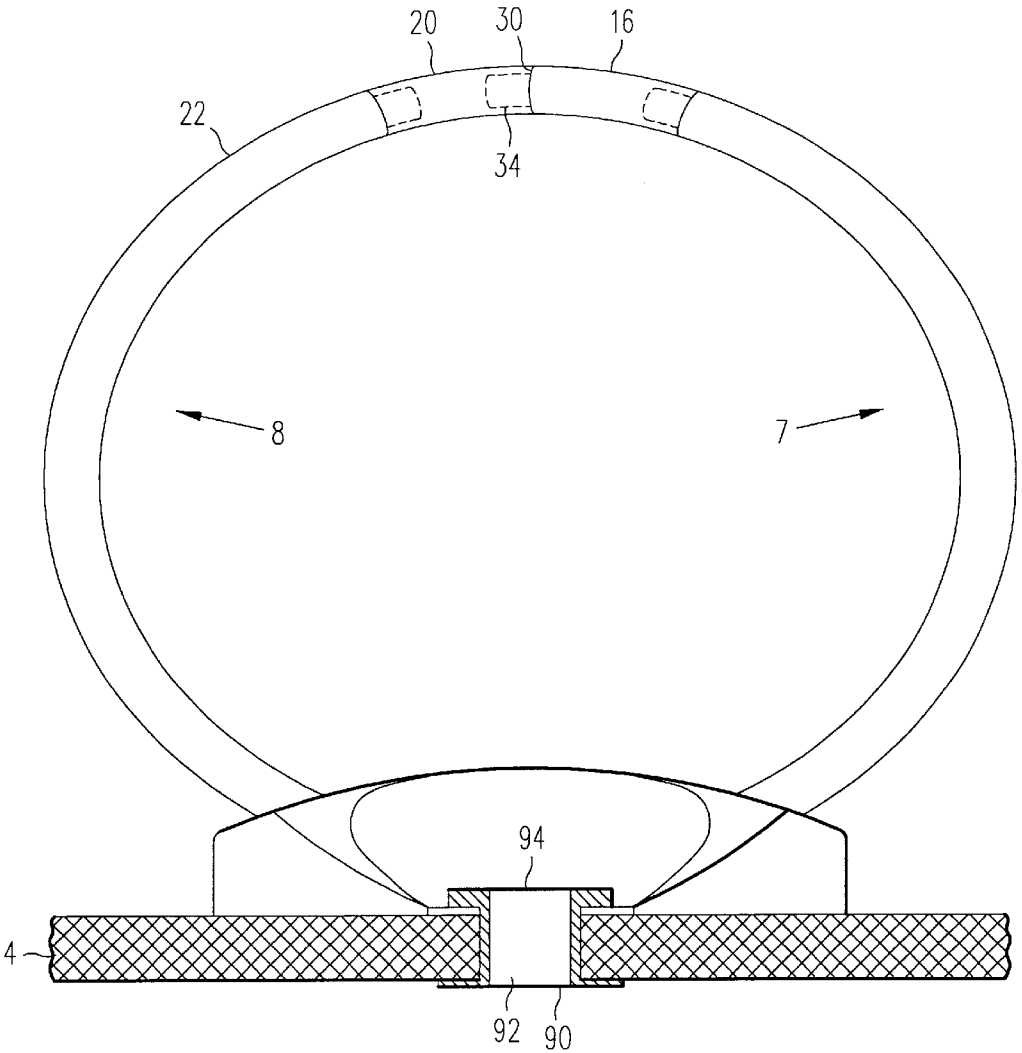
FIG. 9C is an end view of a ring mechanism according to the present invention, showing the ring mechanism in a closed position, in conjunction with a rivet for mounting the ring mechanism to a cover member.
Figure 10:
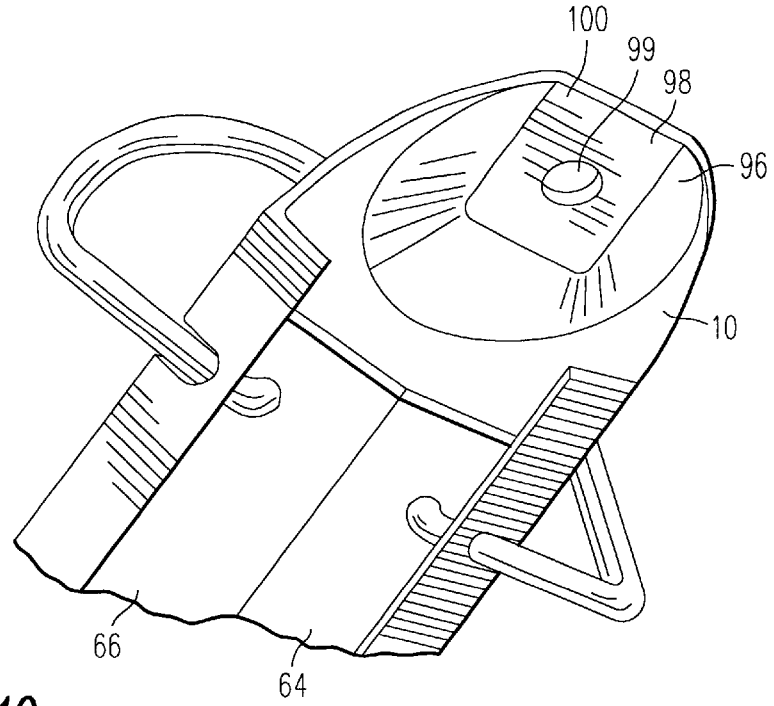
FIG. 10 is a perspective view from below one end of a cover rail in accordance with an embodiment of the invention.

FIG. 9C and FIG. 10 show details of the mounting of cover rail 10 to binder 2 by means of a rivet which passes through aperture 99 in cover rail 10. As shown in FIG. 9C, a rivet 90 is a bushed rivet comprising a main rivet body 92 and a bushing 94. The provision of bushing 94 at either end of cover rail 10 serves to space cover rail 10 above the rear cover member 4 by some desired amount. Additionally, the bushings 92 and rivets 90 serve to permit a small amount of angular movement of the whole mechanism relative to the cover member 4, about a longitudinal axis of the mechanism. Cover member 4 is usually formed from fabric-covered cardboard, which has a natural resilience that accommodates repeated opening and closing of ring elements 7,8.

FIG. 10 shows a perspective view from underneath one end of cover rail 10. As shown, the end of cover rail 10 includes a flattened portion 96 for rivet 90. If desired, a flat area 100 of the flattened portion 98 can be spaced downwards from the main body of cover rail 10, to effectively space the main body of the cover rail 10 above the cover member 4. This could be used instead of, or in conjunction with, bushings 94.

Figure 11:
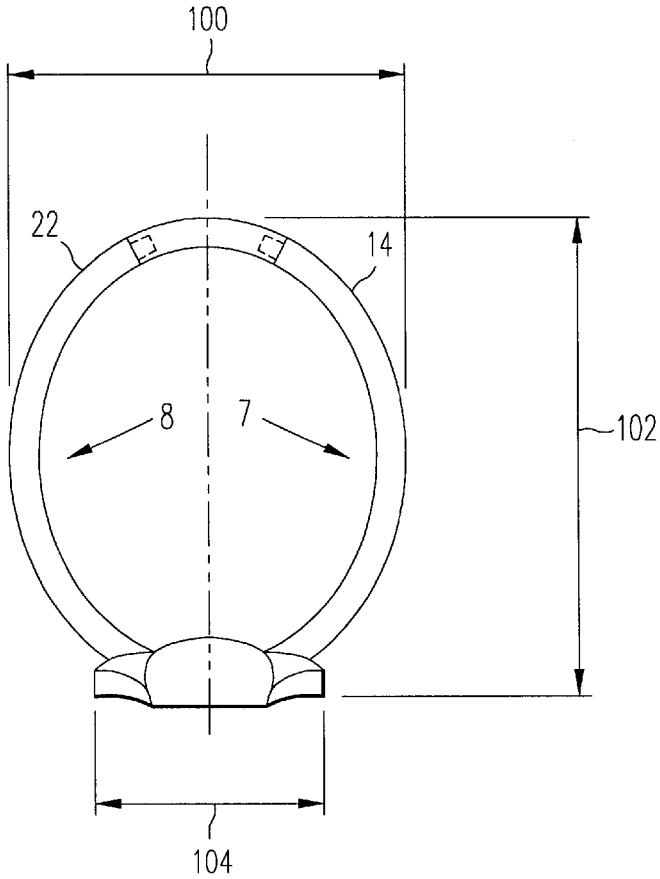
FIG. 11 is a sectional view similar to FIG. 9C of a third embodiment of a ring mechanism of the present invention.

FIG. 11 illustrates exemplary dimensions for a ring mechanism in accordance with an embodiment of the present invention. The maximum width of the ring mechanism, (dimension 100), is 44 mm; the height of the ring mechanism (dimension 102), is 46 mm; and the width of cover rail 10 (dimension 104) is 26 mm. The ring mechanism of FIG. 11 is substantially symmetrical about a vertical plane.

Figure 12:
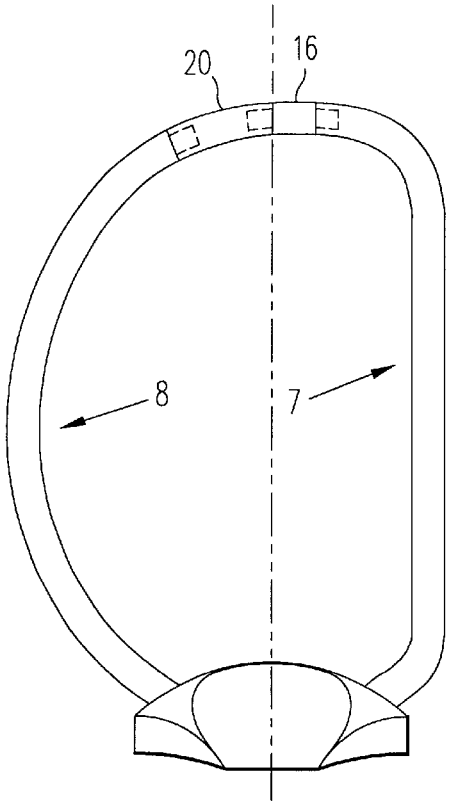
FIG. 12 is a sectional view similar to FIG. 5C of a fourth embodiment of a ring mechanism of the present invention.

FIG. 12 illustrates another embodiment of the ring mechanism, wherein the ring mechanism has a "D" shape. The "D" shape of the ring mechanism makes the ring mechanism substantially asymmetrical about a vertical plane. Advantageously, because ring element 7 includes a long straight segment (relative to its total length), paper sheets may be stacked on that side of the ring in a uniform vertical pile, enabling the user to easily view all index tabs within the pile on that side of the ring simultaneously.

Figure 13:
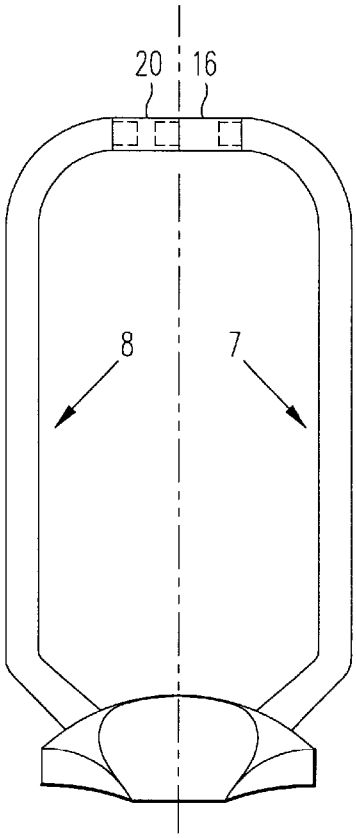
FIG. 13 is sectional view similar to FIG. 5C of a fifth embodiment of a ring mechanism of the present invention.

FIG. 13 illustrates another embodiment of the ring mechanism, wherein the ring mechanism has a "Q" shape. Here, both ring element 7 and ring element 8 include long straight segments. Thus, advantageously, paper sheets may be stacked on both sides of the ring in a uniform vertical pile, enabling the user to easily view all index tabs within the pile on both sides of the ring simultaneously.

The presently disclosed embodiments are illustrative and not limiting; further modifications will be apparent to those skilled in the art in light of this disclosure and are intended to fall within the scope of the appended claims.

What is claimed is:

1. A ring mechanism for mounting on a carrier mechanism of a looseleaf binder having at least one cover member, said carrier mechanism being mounted on said looseleaf binder and operable to hold said ring in an opened or closed position, said ring comprising:

a first ring element; and a second ring element, said first ring element comprising a first ring element bottom section connected to said carrier mechanism, and a first ring element top section, including a first end and a second end, said first end adapted to be joined to said first ring element bottom section;

said second ring element comprising a second ring element bottom section connected to said carrier mechanism, and a second ring element top section, including a first end and a second end, said first end adapted to be joined to said second ring element bottom section;

said second end of said second ring element top section adapted for coupling with said second end of said first ring element top section, wherein said first ring element bottom section, said first ring element top section, said second ring element top section, and said second ring element bottom section define a closed loop when said ring is in said closed position, and further wherein at least one of said first ring element top section and said second ring element top section is plastic and of a color different from said first ring element bottom section and said second ring element bottom section.

2. The ring mechanism of claim 1, wherein said plastic is selected from the group consisting of acrylonitrile-butadiene-styrene (ABS) and nylon.

3. The ring mechanism of claim 1, wherein said first ring element bottom section and said second ring element bottom section are made from a metal.

4. The ring mechanism of claim 3, wherein said metal is selected from the group consisting of steel, aluminum, and galvanized aluminum.

5. The ring mechanism of claim 1, wherein said first ring element bottom section and said second ring element bottom section each comprise a male fitting, and further wherein said first end of said first ring element top section, and said first end of said second ring element top section each comprise a sleeve, said male fitting of said first ring element engaging said sleeve of said first ring element top section, said male fitting of said second ring element engaging said sleeve of said second ring element top section.

6. The ring mechanism of claim 1, wherein said first ring element bottom section and said second ring element bottom section each comprise a sleeve, and further wherein said first end of said first ring element top section, and said first end of said second ring element top section each comprise a male fitting, said sleeve of said first ring element receiving said male fitting of said first end of said first ring element top section, said sleeve of said second ring element receiving said male fitting of said first end of said second ring element top section.

7. The ring mechanism of claim 1, wherein said ring mechanism is substantially symmetrical about a vertical plane.

8. The ring mechanism of claim 1, wherein said ring mechanism is substantially asymmetrical about a vertical plane.

* * * * *